United States Patent [19]

Mausner

[11] 4,408,588

[45] Oct. 11, 1983

[54] APPARATUS FOR SUPPLEMENTARY FUEL METERING IN AN INTERNAL COMBUSTION ENGINE

[75] Inventor: Eberhard Mausner, Ludwigsburg, Fed. Rep. of Germany

[73] Assignee: Robert Bosch GmbH, Stuttgart, Fed. Rep. of Germany

[21] Appl. No.: 359,955

[22] Filed: Mar. 19, 1982

Related U.S. Application Data

[63] Continuation of Ser. No. 117,691, Feb. 1, 1980, abandoned.

[30] Foreign Application Priority Data

Feb. 1, 1979 [DE] Fed. Rep. of Germany ..... 2903799

[51] Int. Cl.[3] ..... F02B 3/00

[52] U.S. Cl. ..... 123/489; 123/492

[58] Field of Search ..... 123/489, 492, 493

[56] References Cited

U.S. PATENT DOCUMENTS

| | | | |
|---|---|---|---|
| 3,973,529 | 8/1976 | Wessel et al. | 123/489 |
| 4,077,364 | 3/1978 | Aoki | 123/489 |
| 4,144,847 | 3/1979 | Hosaka | 123/489 |
| 4,210,114 | 7/1980 | Watanabe | 123/489 |
| 4,240,383 | 12/1980 | Horbelt et al. | 123/492 |
| 4,249,498 | 2/1981 | Drews et al. | 123/492 |

FOREIGN PATENT DOCUMENTS

| | | | |
|---|---|---|---|
| 2030730 | 4/1980 | United Kingdom | 123/489 |

*Primary Examiner*—Parshotam S. Lall

*Attorney, Agent, or Firm*—Edwin E. Greigg

[57] ABSTRACT

An apparatus for supplementary fuel metering in the event of acceleration in an internal combustion engine, the apparatus developing signals by processing means indicative of a level of the increased quantity controllable in response to or in accordance with an operational status, operating characteristics and/or time for controlling an injection valve particularly in internal combustion engines which are driven in the lean range, the apparatus makes the increased quantity of fuel available for use to be dependent in the event of acceleration on the degree of leaning during the period before the acceleration process and dependent on the dimension of the desired acceleration itself. The apparatus for supplementary fuel metering includes a control apparatus for increased fuel quantities which is driven, for instance, in accordance with the output signals of an oxygen sensor and of a differentiating stage for the throttle valve angle.

1 Claim, 1 Drawing Figure

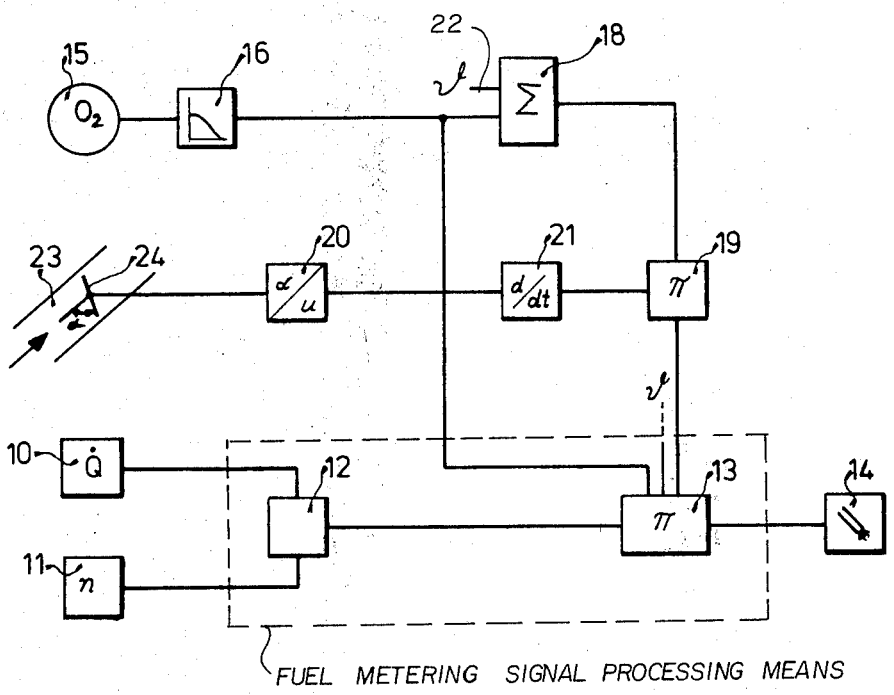
15
$O_2$
16
22
18
$\Sigma$
23
24
20
$\alpha/u$
21
$d/dt$
19
$\pi$
10
$\dot{Q}$
12
13
$\pi$
14
11
$n$
FUEL METERING SIGNAL PROCESSING MEANS

APPARATUS FOR SUPPLEMENTARY FUEL METERING IN AN INTERNAL COMBUSTION ENGINE

This is a continuation, of application Ser. No. 117,691, filed Feb. 1, 1980, now abandoned.

BRIEF SUMMARY OF THE INVENTION

The invention relates to a processing apparatus for developing signals indicative of a level to supplement fuel metering in the event of acceleration in an internal combustion engine, and more particularly relates to apparatus for developing signals by processing means indicative of the level of an increased quantity which is controllable in response to or in accordance with an operational status of the internal combustion engine, operating characteristics thereof and/or speed values or time for controlling the internal combustion engine by supplementary fuel metering in the injection valve.

BACKGROUND OF THE INVENTION

A control apparatus for increased fuel quantity in the case of acceleration is known which has a potentiometer on the throttle valve whose output is carried to a differentiating member and further to the control apparatus for increased fuel quantity. In prior art apparatus a signal indicating change in the throttle valve position merely generates a control signal for an increased fuel quantity. Although as a rule the prior art apparatus may demonstrate good results, there are certain difficulties particularly in the internal combustion engine operated in the lean range because of inadequate adaptation of the fuel requirement to the fuel quantity available for use.

OBJECT AND SUMMARY OF THE INVENTION

The apparatus for supplementary fuel metering in accordance with the invention has the advantage over the prior art in that it can ascertain precisely the increased fuel quantity required at a particular moment on the basis of given operating characteristics, and thus also permits the attainment of an optimal acceleration of the vehicle. A further feature of the invention which is particularly advantageous is the pickup of the increased quantity control signal directly or indirectly from a sensor, located either in the exhaust member or system or in the air intake manifold which detects the composition of the fuel-air mixture. The types of enrichment may be made either on both multiplicatively and additively, i.e., by use of either non-linear or linear processing of signals means, while the behavior of the internal combustion engine itself is also taken into consideration in making the selection between the two possibilities.

The invention will be better understood and further objects and advantages thereof will become more apparent from the ensuing detailed description of a preferred embodiment taken in conjunction with the drawing.

BRIEF DESCRIPTION OF THE DRAWING

The FIGURE is a single exemplary embodiment showing a schematic diagram of a preferred embodiment of the invention.

DETAILED DESCRIPTION OF A PREFERRED EMBODIMENT

Referring now to the drawing there is shown a fuel injection system shown for an internal combustion engine with externally supplied ignition, as well as the apparatus for supplementary fuel metering. An air mass flow meter or air throughout transducer 10 in the intake manifold produces an electrical output and a rotational speed meter or rpm transducer 11 also produces an electrical output, respectively, whose outputs are carried to a timing element 12 of the fuel metering signal processing device which includes a subsequent multiplier stage 13. In this timing element 12 a coarse injection time is ascertained on the basis of the input variables for air throughput and rpm. This coarse injection time is then corrected in the subsequent multiplier stage 13 of the fuel metering signal processing device and as a result the opening duration is determined for at least one injection valve 14. The multiplier stage 13 is embodied as a general correction stage for the injection signal and in addition to an acceleration signal it also processes λ and temperature signals, for instance.

An oxygen sensor 15 is disposed in the exhaust manifold of the internal combustion engine, the output signal of which is carried to a low-pass filter 16. On its output side, this low-pass filter 16 is connected to one of the inputs of the multiplier stage 13 and to a summation element 18, into which a temperature-dependent signal from line 22 is derived by conventional means, for instance, is also fed into input line 22 in order to make the acceleration enrichment dependent especially on temperature as well. The summation stage 18 is followed by a multiplier stage 19. The multiplier stage 19 is triggered in response and on the basis of a measuring transducer 20 for the angular position of the throttle valve 24 and on the basis of a differentiating element 21. The air intake manifold is indicated by reference numeral 23 of the drawing. On the output side the multiplier stage 19 is connected to one of several inputs of the multiplier stage 13.

The mode of operation of the apparatus for supplementary fuel metering shown in the drawing is as follows:

The injection pulses for the injection valve 14 generated in the timing element 12 in accordance with air throughput and rpm are corrected in the multiplier stage in accordance with further operating characteristics such as temperature or exhaust gas composition. Further, in the case of acceleration or the rate of acceleration, the control of increased fuel quantity takes place via the multiplier stage 13. The event of acceleration is recognized on the basis of the derivation over time of the throttle valve position signal. If the throttle valve 24 is thus moved, then the multiplier stage 19 generates an output signal applied to multiplier stage 13 in accordance with the formula:

$$UA = k \cdot d\alpha/dt \cdot \delta(d\alpha/dt) \cdot [f(O_2) + f(\vartheta) + \ldots]$$

$\alpha$ = annular position of the throttle valve; k = constant; and $\sigma(\times)$ = sigma function.

The signal inputs to the multiplier stage 19 thus depends not only on the temperature signal on terminal 22 but also on the output signal of the oxygen sensor 15 and so forth. Thus on the basis of the described arrangement, the supplementary fuel metering in the event of acceleration is to be controlled in accordance with the exhaust gas composition at that time and in accordance with the degree of acceleration which is found greatly advantageous, particularly in engines which are driven at the lean running limits.

Alterations and modifications in the subject shown in the drawing are possible; for instance, a change-over time in the supplementary fuel metering can be made in the case of acceleration if the acceleration process continues over a relatively long period of time and the mixture composition is intended to be altered over this elapsed period. Good results are also obtained if instead of the oxygen sensor signal of the oxygen sensor 15 from the exhaust manifold, a signal is used relating to the mixture composition in the air intake manifold (not shown but well known) of the internal combustion engine; and again, instead of this, a fuel metering signal can also be used, which is generated in any case and is of course also dependent on operating characteristics.

It can also be efficient to embody the multiplier stages 13 and 19 acting as correction elements either individually or both as additive or exponential stages, so as to be able to control the fuel quantity to be furnished in a manner which is as faithful as possible to requirements at that time.

The apparatus for supplementary fuel metering is shown in connection with a fuel injection system for an internal combustion engine. Because the invention relates to the control of increased fuel quantity during the course of acceleration, the manner of fuel metering is accordingly not of significance. However, the invention is particularly applicable to continuous-functioning injection systems in which the fuel pressure, for instance, is then variable. In an appropriately derived manner, however, carburetor systems can also be controlled, either by influencing the carburetor itself—for instance, by electromechanical means—or by the additional occurrence of an injection means. What is essential is only that the acceleration enrichment is selected in accordance with, in general, the operating characteristics and, in particular, the output signal of an oxygen sensor and as needed the degree of desired acceleration.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An apparatus for fuel metering in an internal combustion engine, comprising:

an air mass flow transducer (10) for producing an output, a rotational speed transducer (11) for producing an output, an oxygen sensor (15) for air-fuel closed loop control for producing an output, a fuel metering signal processing means (12, 13) connected to said respective outputs for delivering fuel metering signals, in dependence at least upon the actual air-fuel ratio, means (19) responsive to an acceleration detection means (20, 21) connected to said signal processing means for prolonging said signals continuously during acceleration, said means for prolonging said signal includes a multiplier stage means connected to said fuel metering signal processing means for providing an adaptation signal formed as an output signal of said multiplier stage means in accordance with the formula:

$$UA = k \cdot d\alpha/dt \cdot \delta(d\alpha/dt) \cdot [f(O_2) + f(\vartheta) + \ldots]$$

$\alpha$ = engine operating parameter; k = constant; and $\sigma$ (×) = sigma function.

* * * * *